United States Patent [19]

Morisaki

[11] Patent Number: 4,903,356

[45] Date of Patent: Feb. 27, 1990

[54] BEDCLOTHES

[76] Inventor: Tsutomu Morisaki, 791-2, Nakakoga, Oaza, Okawa-shi, Fukuoka-ken, Japan

[21] Appl. No.: 261,034

[22] Filed: Oct. 21, 1988

Related U.S. Application Data

[63] Continuation-in-part of Ser. No. 35,393, Apr. 7, 1987, abandoned.

[30] Foreign Application Priority Data

Dec. 6, 1986 [JP] Japan ..... 61-290973

[51] Int. Cl.[4] ..... A47G 9/06; A47C 27/00

[52] U.S. Cl. ..... 5/420; 5/448; 5/468

[58] Field of Search ..... 5/461, 468, 446, 447, 5/448, 464, 481, 462, 482, 417, 420

[56] References Cited

U.S. PATENT DOCUMENTS 3,840,923 10/1974 Bos ..... 5/461

FOREIGN PATENT DOCUMENTS 6111459 7/1985 Japan .
6255958 9/1985 Japan .
6345654 9/1986 Japan .

*Primary Examiner*—Alexander Grosz
*Attorney, Agent, or Firm*—James J. Ralabate

[57] ABSTRACT

The bedclothes according to this invention has a substrate sheet on which a plurality of small piece made of paulownia are disposed in zigzags to form a lot of spaces surrounded with the small pieces, and a cushion body is provided on the surface part of the substrate sheet near its side end. The small pieces made of paulownia makes a comfortable condition for a user to sleep or take a rest. The spaces surrounded with the small pieces effectively dispersed the humidity discharged from the human body to the atmosphere, so that the user does not feel sweltering. Owing to the cushion body, the user does not feel numb or pain, even when his arms or elbows are inserted between his head and the bedclothes for a long time.

7 Claims, 7 Drawing Sheets

FIG.1
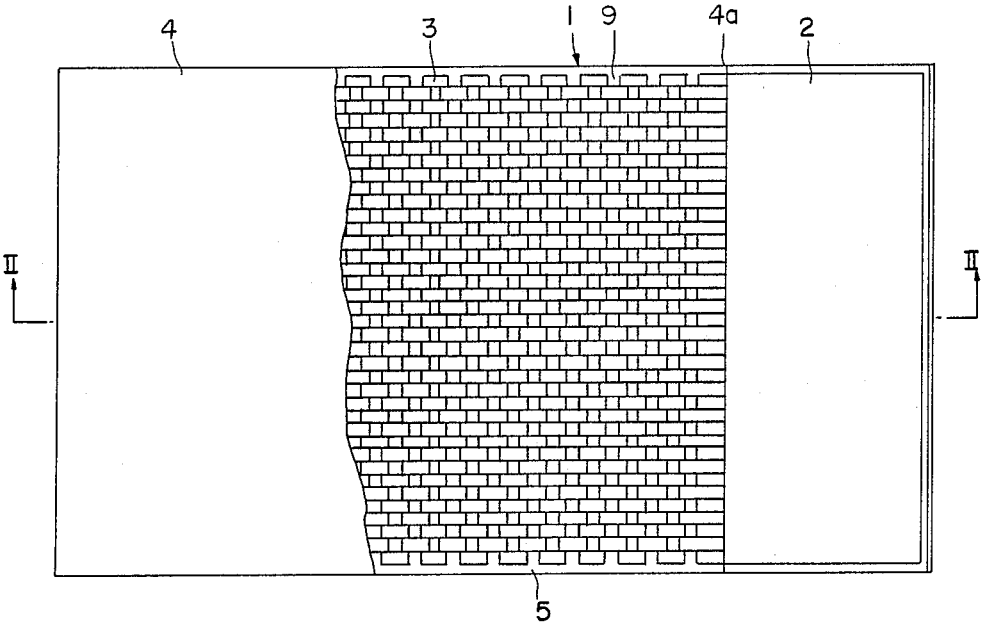
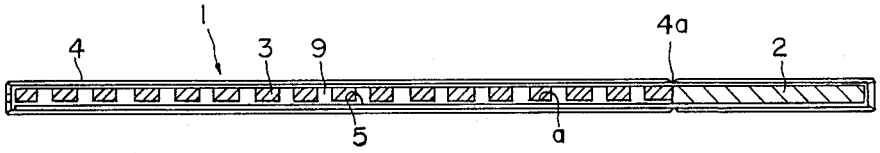
FIG.2

FIG.5
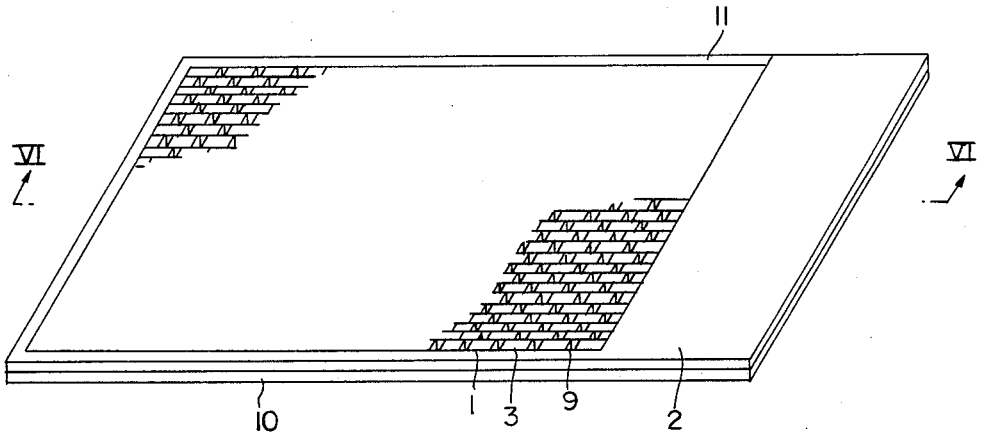
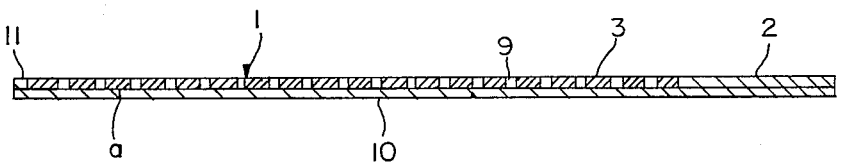
FIG.6

BEDCLOTHES

BACKGROUND OF THE INVENTION

Field of The Invention

This is a continuation-in-part application of U.S. patent application Ser. No. 07/035,393 filed Apr. 7, 1987 now abandoned, and relates to an improvement in bedclothes to be used as a sleeping mat or over-mattress.

PRIOR ART

The inventor has achieved many improvements in said bedclothes as disclosed in the specifications of Japanese utility Model Application No. 60-103139 (filed on July 6, 1985, Unexamined Publication No. 62-11459), Application No. 60-148884 (filed on Sept. 28, 1985, Publication No. 62-55958), Application No. 61-139228 (filed on Sept. 9, 1986, Publication No. 63-45654). These improvements are aimed at keeping the mattress dry even during sleeping when the user may perspire. It is also useful in keeping the user's body healthy, warm and comfortable during use.

For instance, the sleeping mattress shown in the specification of said Application No. 60-103139 comprises a plurality of small pieces arranged in one plane. Each small piece has a couple of through-holes formed near both ends of side walls, and are disposed in contact with the alternate side part of an adjacent small piece while running wire through the holes of these small pieces. The bedclothes or mat shown in the specification of said Application No. 60-148884 comprises a main cushion body on which a combination of a plurality of small pieces are attached. The folding mattress shown in the specification of said Application No. 61-139228 comprises a foldable cushion body in which a plurality of small pieces are combined and lapped each each other. Said cushion body together with the combined small pieces are wrapped in a cover.

When a user lies on such a mat or mattress, a heat-insulating layer is formed between the human body and the structure containing the cushion body and the small pieces. This heat-insulating layer is effective in keeping the human body warm. In addition, the humidity discharged from the human body is dispersed through the heat-insulating layer so the user feels comfortable, free from the moisture caused by perspiration.

However, there are problems which still remain to be resolved. When the user lies on the mat or mattress to take a rest, the user sometimes lays his head down on his arm. In this position, the arms or elbows are pressed onto the small pieces arranged on the cushion body. If the user keeps this position for a long time, the arms or elbows become numb and painful.

Besides, each piece is likely to stand upright when the mat or mattress is spread down on a floor or bed. When this occurs, these small pieces form protrusions rising from the plane of the mat or mattress. These obviously are uncomfortable to the human body.

Therefore, one object of the present invention is to resolve these problems to obtain comfortable mat for use as an over-mattress.

Another object of this invention is to form a portion on which a user may lay his head, arms or elbows without coming in contact with small pieces.

Still another object of the present invention is to keep small pieces flat in one plane without forming protrusion under any conditions.

Yet another object of the present invention is to offer a mat which feels soft to the human body.

SUMMARY OF THE INVENTION

To achieve the aforesaid objects, the mats according to the present invention comprise an elongated configuration comprising a substrate sheet, a combined assembly of small pieces fixed onto the surface part of said substrate sheet, and a cushion body. The cushion body is positioned at one end of said elongated configuration. The small pieces have hexahedral shape and are made of paulownia (empress tree). The small block-like pieces have holes or conduits extending therethrough and are arranged in a zigzagged juxtaposed position to each other and overlap at their end portions to form spaces therebetween. These small pieces are combined together in a zigzag fashion by running a wire through the holes thereby connecting adjacent aligned pieces to form spaces therebetween.

The other mats according to the present invention comprise an elongated configuration comprising a substrate sheet, a plurality of small pieces provided on the surface part of said substrate sheet, and a cushion body fixed onto the other surface part of said substrate sheet at one end of said elongated configuration. Each small piece adheres onto the surface part of said substrate sheet in a zigzag fashion so as to form a lot of spaces surrounding said small pieces.

BRIEF DESCRIPTION OF THE DRAWINGS

FIG. 1 is a perspective view of an over-mattress or mat according according to the present invention having the cover for said mat partially cutaway;

FIG. 2 is a cross-sectional view taken along the line II—II of FIG. 1;

FIG. 5 is another perspective view of the over-mattress or mat according to the present invention;

FIG. 6 is a cross-sectional view taken along the line IV—IV of FIG. 5;

DESCRIPTION OF THE PREFERRED EMBODIMENTS

The features of the present invention will become apparent from the following:

EXAMPLE 1

Figure 4A:
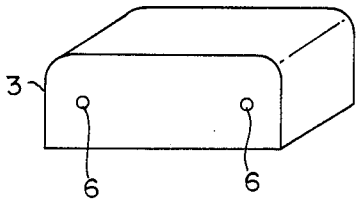
FIGS. 4*a*, 4*b* and 4*c* are perspective views illustrating different types of small pieces useful in the present invention.
Figure 4B:
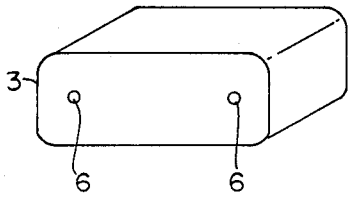
Figure 4C:
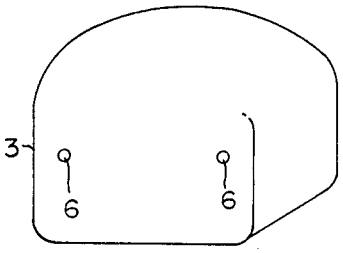

An over-mattress or mat according to the present invention includes a plurality of small pieces 3 as shown in FIG. 1. Each small piece 3 is prepared by cutting paulownia in to the hexahedral shape as shown in FIGS. 4*a*, 4*b* or 4*c*. In FIG. 4*a*, the small piece 3 has its top or upper corners chamferred. In FIG. 4*b*, all corners of the small piece 3 are chamferred, that is, all are rounded.

In FIG. 4*c*, the small piece 3 of relatively large thickness has an upper surface formed into a convex curved state. Any small piece 3 shown in FIGS. 4*a*, 4*b* or 4*c* has a flat side surface and two or a couple of through-holes 6, 6 extending from one side surface to the other side surface. These through-holes or conduits are formed in parallel with each other near the end surfaces of the hexahedral shape.

Figure 3A:
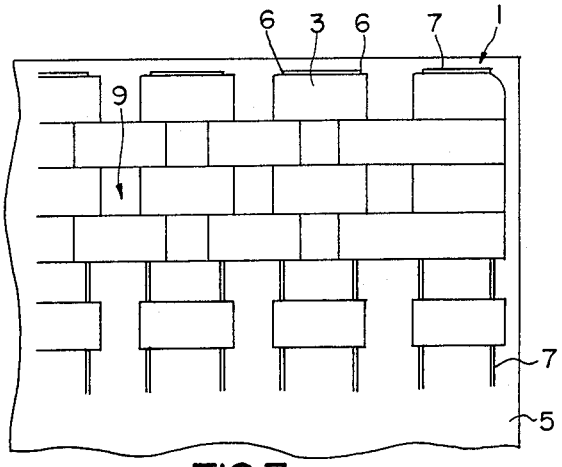
FIGS. 3*a* and 3*b* are enlarged plane views of different combined small pieces.
Figure 3B:
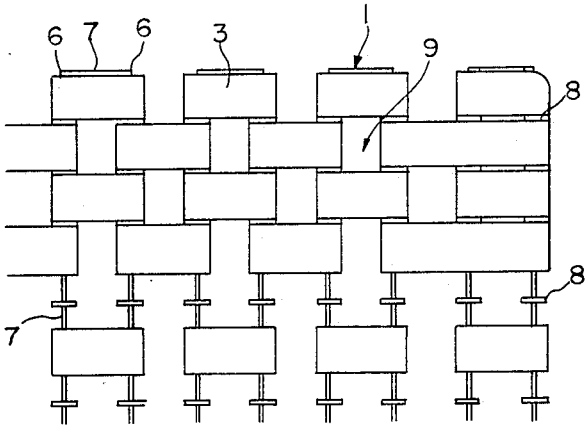

These small pieces 3 are combined or secured together by strong wires 7 made of thread, cord, string or the like, in a manner such that the adjacent small pieces 3 are overlapped at their side ends as shown in FIGS. 3*a* and 3*b*. The small pieces 3 are secured together, for instance, by passing the wire 7 through the right side hole or conduit 6 of the small piece 3 in the first line and then through the left side hole or conduit 6 of the small piece 3 in the next line. Consequently, the small pieces 3 are arranged in zigzags as shown in FIG. 3*a* to form a lot of spaces 9 (shown in FIG. 2). These spaces 9, in combination with the small pieces 3, have a significant influence on the ventilation and heat insulation of the mat or over-mattress. The number of spaces 9 desired are determined by the desired ventilation, heat insulation, weight and structural strength of the mat or over-mattress. As the capacity of the spaces 9 becomes larger, the combined assembly 1 of the small pieces 3 becomes lighter. As the capacity becomes smaller, the combined assembly 1 becomes stronger.

The combined assembly 1 of the small pieces 3 is adhered onto a substrate sheet 5 by a proper adhesive as shown in FIG. 2. The substrate sheet 5 includes a cushion body 2 packed with soft material, e.g. fibers or feathers. Instead of using such material, the cushion body 2 itself may be made of hardened cotton, cotton cloth, non-woven fabric of processed polyester cotton, felt, polyurethane foam, etc. The length of the cushion body 2 shall be determined so that the user can take a rest while keeping his head on his arms or elbows while not coming in contact with the small pieces.

In this embodiment, the combined assembly 1 and the cushion body 2 are both enclosed within a cover 4 made of thin cloth. A part of the cover 4 corresponding to the boundary between the cushion body 2 and the combined assembly 1 is seamed 4*a* which is used to inhibit the movement of the combined assembly 1 into the cushion body 2.

Shock absorbers 8 made of rubber, plastics or cloth may be inserted between the adjacent small pieces 3 as shown in FIG. 3*b*. In FIG. 3*b*, the shock absorbers 8 and the small pieces 3 are alternatively threaded by the wire 7. The shock absorbers 8 effectively inhibit the direct contact between the adjacent small pieces 3 so that each piece 3 is not damaged by friction upon continued use. Since the direct contact between the adjacent small pieces 3 does not occur the over-mattress or mat can be used without the occurence of a clattering noise. Instead of the shock absorbers 8, rubber cement or the like may be applied onto the side surfaces, especially a part near the through-hole or conduit 6 of each small piece 3.

Figure 3C:
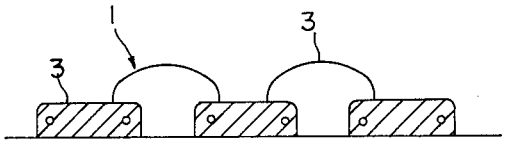
FIG. 3*c* is an enlarged cross-sectional view illustrating the embodiment wherein small pieces having ordinary thickness are combined with thick small pieces.

The combined assembly 1 may sporadically include small pieces having relatively large thickness as shown in FIG. 3*c*. Such a relatively thick small piece is illustrated in FIG. 4*c*. The thickner small piece 3 partially stimulates the human body when the user lies down on the mat or over-mattress. Consequently, the same effect as finger-pressure therapy can be obtained.

The material of the small piece 3 is paulownia. The paulownia has the lowest specific gravity among woods, relatively low thermal conductivity and high heat insulating power. The rate of the paulownia for forming a vascular tissue is only 17.8%, extremely low as compared with the other kinds of woods. Tyloses have developed well especially in the vessels of spring wood material so that the vessels are divided minutely but not elongated. Consequently, the combined assembly 1 of the small pieces 3 is always kept dry so that the user can sleep or comfortably take a rest on the over-mattress. In addition, from recent experiments, the inventor discovered the vigorous radiation of far infrared rays from the paulownia pieces 3 when the combined assembly 1 becomes warm due to the heat of the human body upon use. As a result, the user feels warm during usage without the necessity of any electric heater.

The spaces 9 which surround the small pieces 3 are effective in ventilation and heat insulation. When a cover 4 made of finely-knitted cloth is used to enclose the combined assembly 1, the air in the spaces 9 hardly disperses to the outside. The interior of the over-mattress, upon receiving the heat of the human body, is kept warm so that the user feels warm especially in a cold season. When a cover 4 having excellent air permeability is used, the air in the spaces 9 is easily ventilated. Consequently, the humidity discharged from the human body is dispersed through the spaces 9 to the atmosphere or a sleeping surface on which the over-mattress is spread. As a result, the over-mattress also becomes suitable for use in a hot season. In this regard, the cover 4 is preferably detachably attached to the over-mattress by any convenient means such as fasteners, zippers, hooks, etc. The selection of a cover 4 would be determined by the season in which the over-mattress is used.

The over-mattress as aforementioned is usually used in a state stretched on an ordinary sleeping surface or mattress, or stretched directly on a floor or tatami mat. Since each small piece 3 is adhered to, the substrate sheet 5 by an adhesive a (as shown in FIG. 2), these small pieces 3 will not stand upright from the substrate sheet 5. Consequently, all of the small pieces 3 remain during use in one flat plane and do not cause any discomfort to the user.

EXAMPLE 2

Another example of the over-mattress according to the present invention is illustrated in FIGS. 5 and 6. This over-mattress has a substrate sheet 10 made of hardened cotton, polyurethane foam or the like. The elongated substrate sheet 10 acts as a cushion. A cushion body 2 on which the head, arms or elbows of the user will be laid is provided on the surface part of one end of the elongated substrate sheet 10. Below the cushion body 2 on the remaining surface part of the substrate sheet 10, a plurality of small pieces 3 made of paulownia are disposed in a zigzag configuration.

The cushion body 2 is fixed to one end of the surface part of the substrate sheet 10 by sewing or a proper adhesive. Each small piece 3 adheres onto the surface of the substrate sheet 10 by an adhesive a which is applied on the lower surface of the small piece 3. Since the small pieces 3 are disposed in a zigzag configuration on the substrate sheet 10, a plurality of spaces 9 are formed surrounding the small pieces 3. These spaces 9 act as a heat insulation layer during use, so that the heat of the human body is not undesirably dispersed to the sleeping mat or the atmosphere. The periphery of the small pieces 3 located at the edge of the mat is surrounded with an edge member 11 made of hardened cotton or the like. This edge member 11 is provided so that the edge of the small pieces 3 located at the periphery of the substrate sheet 10 will not come in direct contact with the skin of the user.

Figure 7:
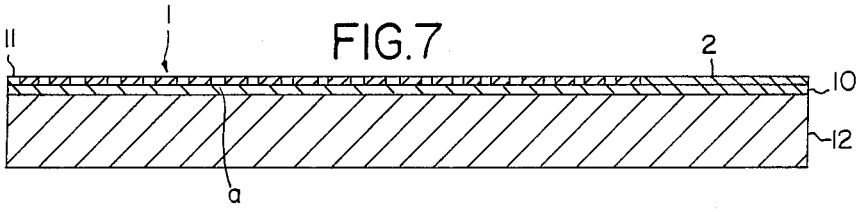
FIG. 7 is a cross-sectional view of the over-mattress or mat (shown in FIG. 5) stretched over a conventional cushion or mat.

Since each small piece 3 adheres to the substrate sheet 10, its relative position on the substrate sheet 10 is maintained constant. When the over-mattress is stretched out on a sleeping surface or mat 12 as shown in FIG. 7, no small piece 3 will stand upright from the surface of the over-mattress.

Consequently, upright protrusions of small pieces 3 which will cause discomfort to the human body are avoided. The same is the case when the over-mattress is directly stretched onto the floor or tatami mat.

The user can lay his body directly on the small pieces 3, since the small pieces 3 made of paulownia have sufficient softness. Of course, a cloth sheet or blanket may be stretched over the small pieces 3 for use. In any case, his head is positioned on the cushion body 2. His arms or elbows to support the head are likely to be positioned between the head and the over-mattress. Hereon, the part of over-mattress where the arms or elbows are to be positioned is coated with the cushion body 2 but not the small pieces 3, so that the arms or elbows do not become numb or painful.

The mat of this invention useful as a sleeping mat or over-mattress comprises the assembly of small pieces made of paulownia at the part of the mat where the body of the user is positioned. The small pieces 3 made of paulownia have the lowest specific gravity, low thermal conductivity and good heat insulation, so that the user can sleep or take a rest under comfortable conditions. In addition, the small pieces are disposed in a zigzag configuration on the substrate sheet to form a plurality of spaces which are effective in ventilation. Consequently, the humidity discharged from the human body is dispersed through the spaces to the sleeping mat or the atmosphere, and the user can get a good rest or sleep without feeling fatigued.

Figure 8:
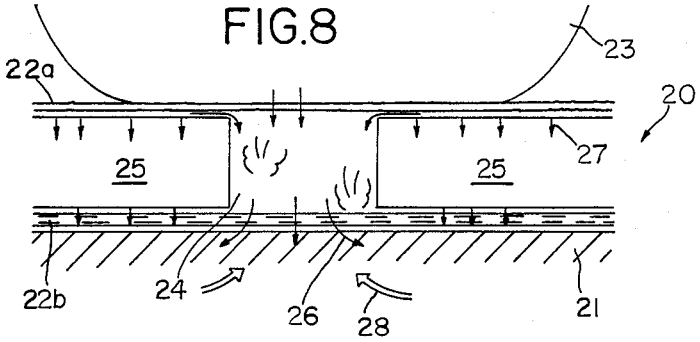
FIG. 8 is a partial cross-sectional view where the human body is laid on the over-mattress.
Figure 9:
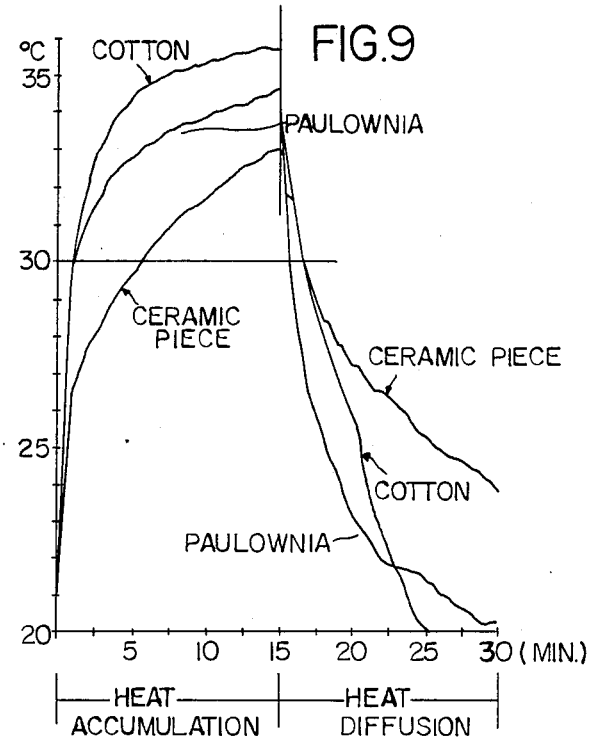
FIG. 9 is the temperature curve of a small piece from paulownia as compared with those small pieces made of cotton and ceramic.

The relationship between the human body and the over-mattress is illustrated in FIG. 8, wherein the over-mattress 20 to be laid on an ordinary sleeping surface or mat 21 is enclosed with a cover 22*a*, 22*b*. When the human body 23 is laid on the over-mattress 20, the spaces 24 are enclosed by the small pieces 25, the sleeping mat 21 and the human body 23. Humidity discharged from the human body 23 is dispersed through the spaces 24 and absorbed (as shown by the arrow 26) in the sleeping mat 21. The heat from the human body 23 is transmitted to the small pieces 25 as shown by the arrow 27. Consequently, the surface temperature of the small pieces 24 rises as shown in FIG. 9. Even when said temperature approaches the body temperature, the user does not become sweltered because of the sufficient dispersion of the humidity through the spaces 24.

On the contrary, when an over-mattress or mat merely made of cotton is used, the surface of the over-mattress reaches a higher temperature. The humidity from the human body is wholly absorbed in the cotton. In addition, the human body is kept in close contact with the surface of the over-mattress, so that the permeability becomes lower. Consequently, the user feels sweltered. When an over-mattress having ceramic pieces instead of the small pieces made of paulownia is used, the surface temperature of the ceramic pieces does not rise much because of their large heat capacity. The spaces surrounding the ceramic pieces do not reach a higher temperature, since the heat from the human body is substantially absorbed in the ceramic pieces. Consequently, the user feels chilled for a long time. Besides, when the surface of the ceramic pieces becomes wet, the user feels damp because of the retained perspiration.

When the user sleeps or rests on the over-mattress, he will sometimes turn over in the bed. By turning over, the spaces 24 are changed from the closed state (as shown in FIG. 8) to a state open to the atmosphere. As a result, the air in the spaces 24 is diffused to the atmosphere, and the humidity absorbed in the sleeping mat 21 is discharged through the spaces 24 to the atmosphere as shown by the arrow 28. By this ventilation, the small pieces 25 as well as that of the spaces 24 lower the temperature. In this case, the surface temperature of the paulownia small piece falls at a relatively higher speed on the initial stage and then slowly, as shown in FIG. 9.

Figure 10:
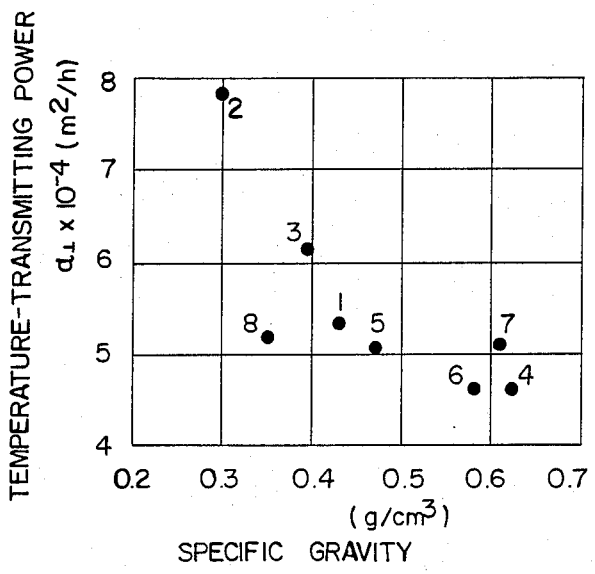
FIG. 10 is a diagram which shows the temperature-transmission power of various kinds of wood.
Figure 11:
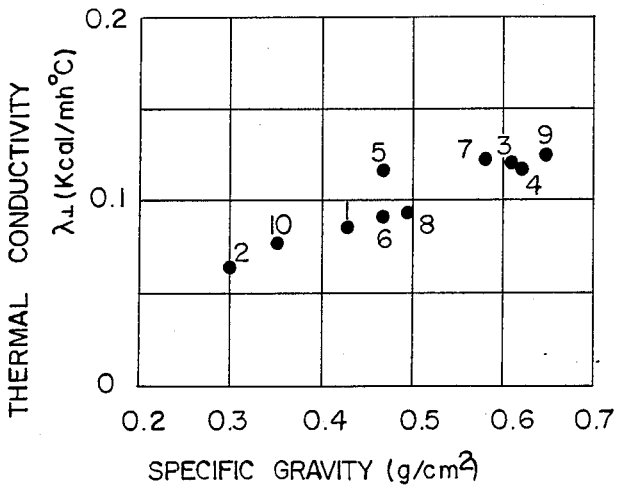
FIG. 11 is a diagram which shows the heat conductivity of various kinds of woods.

This is caused by the thermal property of paulownia. That is, the temperature-transmitting power of paulownia is the highest among the woods, as shown in FIG. 10. The temperature is transmitted to the surroundings mainly through the surface area of the small piece. Owing to this highest temperature-transmitting power, the surface temperature of the small piece falls and continues uniformly at a relatively higher speed on the initial stage. On the other hand, the paulownia has the lowest thermal conductivity among the woods, as shown in FIG. 11. Owing to this lowest thermal conductivity, the heat once accumulated in the paulownia piece is hardly dispersed to the atmosphere, so that the temperature of the paulownia small piece does not fall so much on the latter stage.

The temperature-rising and falling curve of paulownia (as shown in FIG. 9) is effective in making the condition comfortable for the user to sleep or rest on the over-mattress. When the human body is kept on some small pieces, the temperature of the small pieces rapidly rises near the body temperature so that the condition on the over-mattress becomes comfortable for the user in a few minutes. When the user turns over in the bed, the temperature of the paulownia small piece rapidly falls to 22°-23° C., but the lowering of the temperature becomes slower. Consequently, the human body comes in contact with the small pieces whose temperature does not fall so much, when the user turns over again so as to close the opened spaces. In addition, the user feels refreshed without feeling chilled, since the humidity is discharged through the opened spaces to the atmosphere.

On the contrary, in case of using an over-mattress merely made of cotton, the surface temperature of the over-mattress reaches a higher temperature as shown in FIG. 9, so that the user feels hot. When the user turns over, the surface layer of the over-mattress which is separated from the contact with the human body falls to a lower temperature. Consequently, the user feels chilled, when he turns over again so as to come again in contact with said surface layer whose temperature has fallen. In case of using an over-mattress having ceramic pieces instead of paulownia small pieces, it takes a long time to raise the temperature of the ceramic pieces near the body temperature as shown in FIG. 9, the user feels chilled for a long time. Besides, the ceramic piece opened to the atmosphere after the user turns over in the bed hardly falls its surface temperature. As a result, the user does not feel refreshed.

Furthermore, in this invention, the cushion body is attached to the side part of the over-mattress without disposing the small pieces. Owing to the surface part where the small pieces are not disposed, the user does not feel numb or pain even when his arms or elbows are inserted between his head and the bedclothes for a long time.

I claim:

1. A mat for use as an over-mattress having an elongated configuration which comprises a cover (4), a substrate sheet (10), substantially small block-like pieces (3) and a cushion means (2), said cushion means positioned at one end of said elongated configuration, said substantially small block-like pieces having holes or conduits extending therethrough, and arranged in a zig-zagged juxtaposed position to each other but overlapped only at their end portions to form spaces therebetween, said end portions connected by connecting means such as cord or wire, said connecting means extending through said holes in said block-like pieces to thereby connect said end portions together, said block-like pieces extending throughout said elongated configuration except for said cushion means (2) said block-like pieces having at least portions of their corners chamferred, said block-like pieces made of paulownia and having a substantially hexahedral shape, said cover enclosing the entire said over-mattress.

2. The over-mattress of claim 1 wherein only the top corners of said block-like pieces are chamferred.

3. The over-mattress of claim 1 wherein all corners of said block-like pieces are chamferred.

4. The over-mattress of claim 1 wherein the block-like pieces have a top which is of a convexed curved configuration.

5. The over-mattress of claim 1 having shock absorbers between the surfaces of adjacent block-like pieces.

6. The over-mattress of claim 1 having block-like pieces of at least two different configurations.

7. The over-mattress of claim 1 having a soft flexible layer adjacent one surface of said substrate sheet and extending throughout substantially the entire elongated configuration of said over-mattress.

* * * * *